United States Patent [19]

Keyes, IV et al.

[11] Patent Number: 4,574,746

[45] Date of Patent: Mar. 11, 1986

[54] PROCESS HEATER CONTROL

[75] Inventors: Marion A. Keyes, IV, Chagrin Falls; Robert E. Pocock, Highland Hts., both of Ohio

[73] Assignee: The Babcock & Wilcox Company, New Orleans, La.

[21] Appl. No.: 671,524

[22] Filed: Nov. 14, 1984

[51] Int. Cl.[4] ..... F22B 37/42; F22D 5/00

[52] U.S. Cl. ..... 122/448 S; 236/14; 236/15 E

[58] Field of Search ..... 236/14, 15 E; 122/448 R, 448 S

[56] References Cited

U.S. PATENT DOCUMENTS

| | | | |
|---|---|---|---|
| 3,417,737 | 12/1968 | Shinskey et al. | 122/448 R |
| 3,774,396 | 11/1973 | Borsi et al. | 236/14 X |
| 3,877,636 | 4/1975 | Sato | 122/448 R X |
| 4,253,404 | 3/1981 | Leonard | 122/448 S X |
| 4,457,266 | 7/1984 | La Spisa | 236/14 X |

*Primary Examiner*—Edward G. Favors

*Attorney, Agent, or Firm*—Vytas R. Matas; Robert J. Edwards

[57] ABSTRACT

A method for controlling a process heater in which a required heat demand is computed based on the enthalpy of the feed stock and the desired enthalpy of the final product, and then used as a feedforward portion of the fuel control. A second embodiment of the invention is based on the assumption that the feed stock enthalpy changes slowly or infrequently. In this embodiment fuel heating value changes are used as a feedforward portion of the fuel control.

5 Claims, 2 Drawing Figures

PROCESS HEATER CONTROL

PROCESS HEATER CONTROL

PROCESS HEATER CONTROL

PROCESS HEATER CONTROL

TECHNICAL FIELD

The present invention relates to the control of combustion in a process heater, and more particularly to a method for controlling such temperature in a manner such that feed stock enthalpy and/or heating value of the fuel can vary without upsetting the final product temperature.

BACKGROUND ART

In accordance with the prior art the fuel to a process heater is controlled by the final product temperature. This control method corrects for changes in feed stock enthalpy and heating value of the fuel, but only after the final product temperature has been upset. These temperature variations cause upsets in the downstream process, which result in a loss of efficiency and possibly a wide variation in final product quality. Currently used process heater control systems have focused on increased combustion efficiency, however, little attention has been paid to feedforward control to diminish upsets in the temperature of the products leaving a process heater.

SUMMARY OF THE INVENTION

In accordance with the present invention, the enthalpy of the feed stock is computed, along with the desired enthalpy of the product. The required heat demand is computed from these calculations and used as a feedforward portion of the fuel control. The total heat flow of the fuel to the burners is calculated from a measure of fuel BTU, Wobbe or other heat index, fuel pressure and flow. This calculated value is compared to the required heat demand and incorporated as a trimming function in the fuel control loop. The final product temperature control is also made part of the fuel control system.

The total heat flow to the burners is used to position the stack damper for fuel/air ratio control. An $O_2$ and/or CO control system trims the stack damper position to insure optimum combustion efficiency, with an efficiency override being provided to limit the heater draft to a safe value.

In accordance with an alternate embodiment of the invention it is assumed that the feed stock enthalpy changes very slowly with time or is changed at infrequent intervals, e.g., weekly or monthly, to meet new production levels. The final product temperature control sets up the fuel flow demand and fuel/air ratio in parallel. Fuel BTU changes are analyzed and used as a feedforward signal to multiply the effect of the master fuel demand value on the fuel flow control valve. The fuel efficiency is finally maintained by utilizing an $O_2$ and/or CO control system to trim the fuel valve to its final position. This efficiency control is limited by a high heater draft control.

DESCRIPTION OF THE PREFERRED EMBODIMENTS

Figure 1:
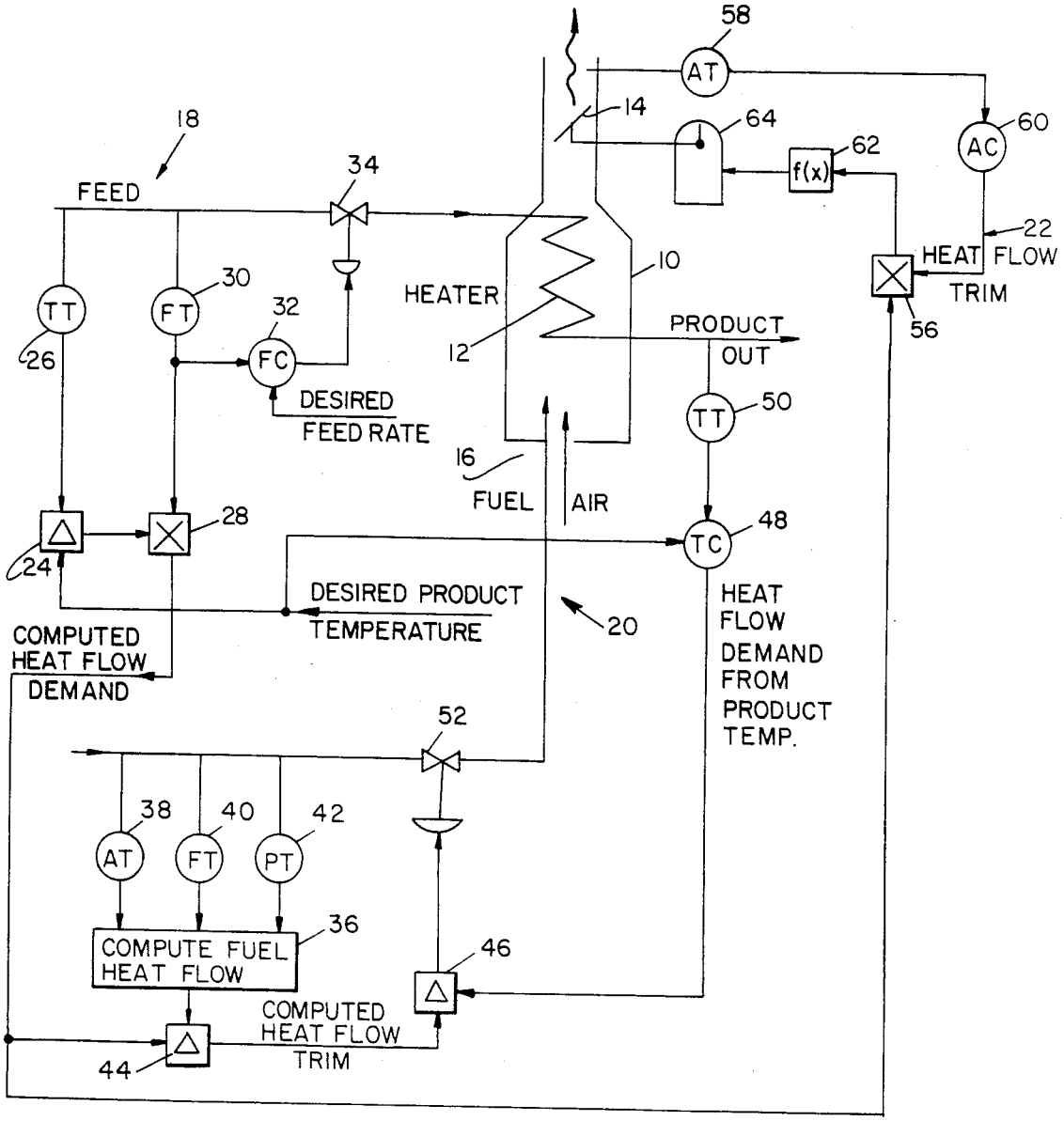
FIG. 1 is a schematic diagram depicting a first embodiment of the invention.

Referring to FIG. 1, there is illustrated a first embodiment of the invention, comprising a heater 10, including a heat exchanger 12, an exhaust damper 14, and a fuel/air inlet 16; a feed system designated generally by the numeral 18; a fuel system designated generally by the numeral 20, and a heat flow trim system designated generally by the numeral 22.

Referring to FIG. 1, the desired product temperature is input to a signal processor 24 along with the feed stock temperature as determined by a temperature transmitter 26. The processor 24 computes the difference between the temperatures, which is then input to a signal processor 28. The feed stock flow rate is determined by a flow transmitter 30, and a flow signal is input to the signal processor which generates a computed heat flow demand signal based on the inlet flow rate and temperature of the feed stock, as will be discussed in further detail below. The feed stock flow rate signal is also input to a flow controller 32, into which is also input a signal representative of the desired feed stock flow rate, the output of the controller 32 being input to a control valve 34 which controls the flow of feed stock to the heater 10.

The flow of fuel to the heater 10 is controlled by a microprocessor 36 in conjunction with trim signals based on the computed heat flow demand and the heat flow demand based on the actual temperature of the output product. The heat value of the fuel is input to the microprocessor by means of a transmitter 38, based on the Wobbe or other heat value index. Fuel flow and pressure signals are also input to the microprocessor by means of transmitters 40 and 42, respectively. The output signal from the microprocessor, which represents a computed fuel heat flow, is input to a signal processor 44 along with the computed heat flow demand signal. The output of the signal processor 44 is a computed heat flow trim signal based on the difference between the computed heat flow and the computed heat flow demand, which is input to a signal processor 46.

A signal representing the heat flow demand based on the final product temperature is also input to the signal processor 46. This signal is generated by inputting the product temperature into a temperature controller 48 by means of a temperature transmitter 50, along with the desired product temperature.

The signal processor 46 combines the heat flow demand signal and the computed heat flow trim signal to provide a signal to a control valve 52 which controls the flow of fuel to the heater 10.

The computed heat flow demand signal from the signal processor 28 is also used to control the damper 14 in the heater stack to optimize combustion efficiency. A signal processor 56 trims the computed heat flow demand signal with a signal from an $O_2$ and/or CO transmitter 58 and a controller 60 which is representative of the $O_2$ and CO in the exhaust stack. The output signal from the signal processor 56 is input to a function generator 62. The function generator 62 inputs to a control drive controller 64 which controls the position of the damper 14.

Figure 2:
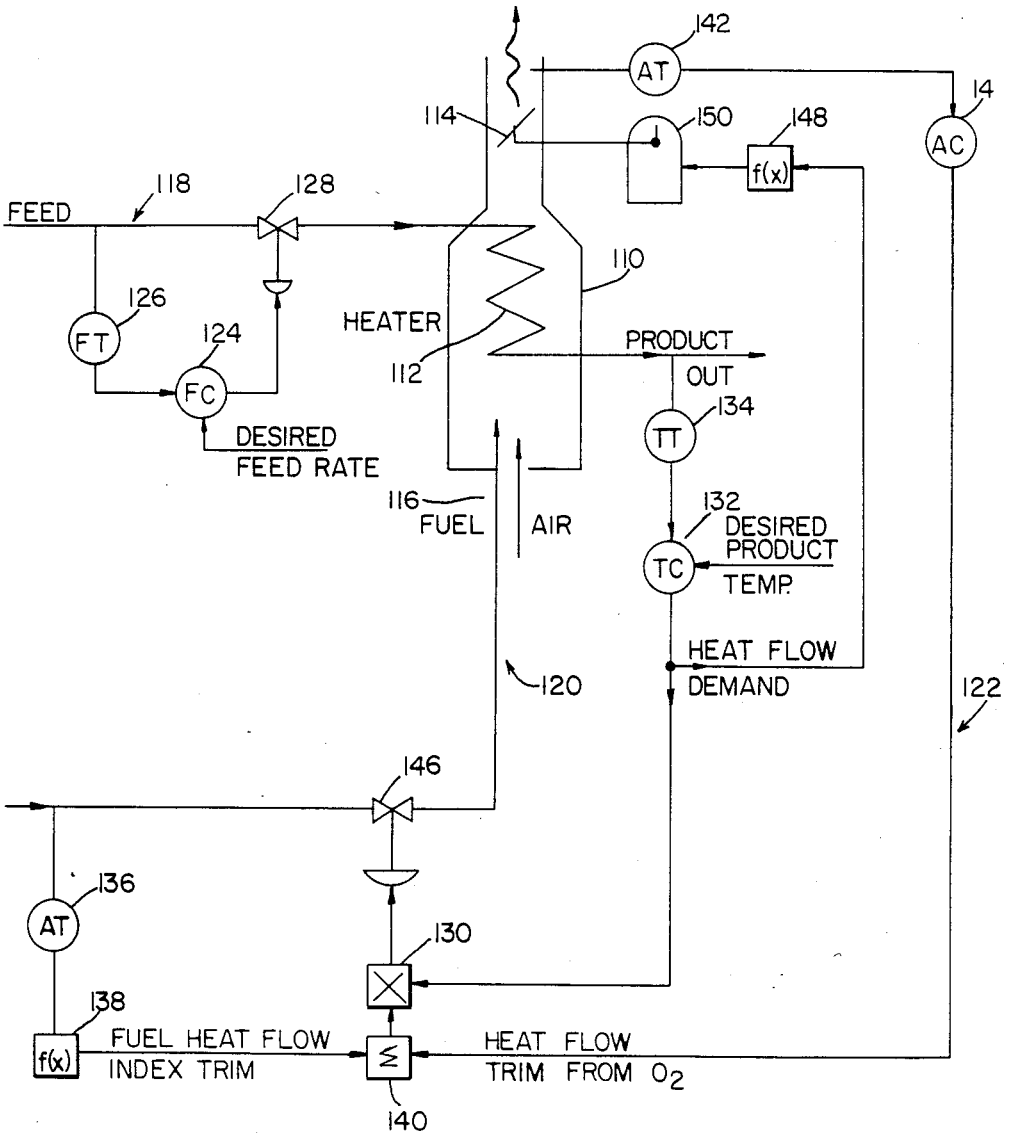
FIG. 2 is a schematic diagram depicting a second embodiment of the invention.

Referring to FIG. 2, there is illustrated a second embodiment of the invention. The second embodiment comprises a heater 110, including a heat exchanger 112, and exhaust damper 114, and a fuel/air inlet 116; a feed system designated generally by the numeral 118; a fuel system designated generally by the numeral 120; and a heat flow trim system designated generally by the numeral 122.

In this embodiment it is assumed that feed stock enthalpy changes very slowly, or is changed only at infrequent intervals to meet new production levels. Referring to FIG. 2, the desired feed rate is input to a flow controller 124, as is the actual feed stock flow rate by means of a flow transmitter 126. The output of the flow controller 124 is input to a control valve 128 which controls the flow of feed stock to the heater 110.

The flow of fuel to the heater 110 is controlled by a signal processor 130, which receives a heat flow demand signal from the product outlet temperature and trim signals based on the fuel heat flow and based on the oxygen content of the flue gas. Heat flow demand is determined by inputting the desired product temperature to a temperature controller 132, along with a signal representative of the product outlet temperature as determined by a temperature transmitter 134. Fuel heat flow trim is determined by inputting the signal from a heat flow index transmitter 136 to a function generator 138 which generates a heat flow trim signal input to a summation block 140. The oxygen content trim signal is determined by an $O_2$ and/or CO content transmitter 142 at the heater flue which inputs to a controller 144, the controller providing a heat flow trim signal which is input to the summation block 140. The summation trim signal is also input to the signal processor 130, which provides a control signal to a control valve 146 which controls the flow of fuel to the heater 110.

In the second embodiment, the damper 114 is controlled by the heat flow demand signal based on the product temperature. The heat flow demand signal input to the signal processor 130 is also input to a function generator 148 which inputs to a control drive 150 controlling the position of damper 114.

Certain modifications and improvements will occur to those skilled in the art upon reading the foregoing. It should be understood that all such modifications and improvements have been deleted herein for the sake of conciseness and readability, but are properly within the scope of the following claims.

We claim:

1. A method for controlling combustion in a process heater comprising the steps of computing a heat flow required to produce a desired final product temperature, controlling the position of the heater stack damper as a function of the computed heat flow, calculating the total heat flow of the fuel to the heater, comparing the calculated heat flow with the required heat flow, and trimming the fuel flow to the heater as a function of the difference between the calculated heat flow and the required heat flow.

2. The method as defined in claim 1, in which said final product temperature is based on the enthalpy of the feed stock and the desired enthalpy of the final product.

3. The method as defined in claim 1, including the step of controlling the heater flue damper position as a function of the computed heat flow as trimmed by a signal which is a function of the oxygen content of the flue gas.

4. A method for controlling combustion in a process heater comprising the steps of generating a first trim signal representative of the oxygen content of the heat flue gas, generating a second trim signal representative of the fuel heat flow index, generating a heat flow demand signal based on the product outlet temperature, and controlling the flow of fuel to said heater based on said heat flow demand signal as trimmed by said first and second trim signals.

5. The method as defined in claim 4, including the steps of summing said first and second trim signals, inputting said sum to a signal processor, inputting said heat flow demand signal to said signal processor, and inputting a control signal from said signal processor to a fuel flow control.

* * * * *